US006652266B1

(12) United States Patent
Murgu et al.

(10) Patent No.: US 6,652,266 B1
(45) Date of Patent: Nov. 25, 2003

(54) FLAME SENSOR AND METHOD OF USING SAME

(75) Inventors: Cristian Murgu, Coquitlam (CA); Edgar C. Robinson, Vancouver (CA)

(73) Assignee: International Thermal Investments Ltd., Richmond (CA)

( * ) Notice: Subject to any disclaimer, the term of this patent is extended or adjusted under 35 U.S.C. 154(b) by 26 days.

(21) Appl. No.: 09/579,444

(22) Filed: May 26, 2000

(51) Int. Cl.[7] ..... F23N 5/08

(52) U.S. Cl. ..... 431/79; 431/14; 431/15; 431/16; 340/578; 250/554

(58) Field of Search ..... 431/79, 13, 14, 431/15, 16, 26; 340/578; 250/554

(56) References Cited

U.S. PATENT DOCUMENTS

| | | | | | |
|---|---|---|---|---|---|
| 3,307,608 | A | * | 3/1967 | Cowan | |
| 3,465,149 | A | * | 9/1969 | Flint | |
| 3,902,841 | A | * | 9/1975 | Horn | |
| 4,039,844 | A | * | 8/1977 | MacDonald | 250/214 AG |
| 4,322,723 | A | * | 3/1982 | Chase | 340/507 |
| 4,435,149 | A | * | 3/1984 | Astheimer | |
| 4,471,221 | A | * | 9/1984 | Middleton et al. | 250/339.15 |
| 4,823,114 | A | * | 4/1989 | Gotisar | |
| 4,878,831 | A | * | 11/1989 | Ewing | 250/339.15 |
| 4,983,853 | A | * | 1/1991 | Davall et al. | 250/554 |
| 5,256,057 | A | * | 10/1993 | Grow | |
| 5,317,165 | A | * | 5/1994 | Montagna | 250/227.23 |
| 5,332,386 | A | * | 7/1994 | Hosome et al. | |
| 5,549,469 | A | * | 8/1996 | Wild et al. | |
| 5,763,888 | A | * | 6/1998 | Glasheen et al. | 250/372 |
| 6,373,393 | B1 | * | 4/2002 | Matsukuma et al. | 250/339.15 |

FOREIGN PATENT DOCUMENTS

| | | | | |
|---|---|---|---|---|
| CA | 2143058 | | 8/1996 | |
| EP | 0308831 | * | 3/1989 | 431/79 |
| EP | 0320082 | * | 6/1989 | 431/79 |
| JP | 55-94118 | * | 7/1980 | 431/79 |
| JP | 2-97823 | * | 4/1990 | 431/79 |
| WO | WO 91/09389 | * | 6/1991 | 431/79 |

* cited by examiner

*Primary Examiner*—Carl D. Price
(74) *Attorney, Agent, or Firm*—John Russell Uren

(57) ABSTRACT

A flame sensor for sensing the presence of a flame in a burner. The signal from the sensor is passed to an amplifier located adjacent to the sensor and amplified without having a sensor signal contaminated with common mode radiation. The selectively amplified signal between 15 and 80 Hz is processed by a microcontroller located remotely from the sensor and amplifier which microcontroller may terminate or continue burner operation. The integrity of the connection circuitry between the amplifier and the microcontroller is also monitored and burner shutdown occurs if there is a fault in such circuitry.

13 Claims, 12 Drawing Sheets

FLAME SENSOR AND METHOD OF USING SAME

This invention relates to a flame sensor for a burner and, more particularly, to a flame sensor in which pulsed signal amplification occurs at or near the sensor itself and further wherein the pulsed signal being sensed is monitored to ensure circuit integrity between the amplifier and a microcontroller which controls burner operation.

BACKGROUND OF THE INVENTION

Flame sensors are used to sense the presence or absence of a flame in a heater or burner, for example, or other apparatus. The heater or burner may be used to heat water or ambient air and the fuel used may be one of several different types.

In the event the flame is extinguished, although not deliberately so, the sensor is adapted to sense the absence of the flame. The flame can be extinguished, for example, by fuel starvation or other malfunction. After sensing the extinguishing of the flame, the sensor or its related circuitry will send an alarm signal to a microcontroller. The microcontroller will take appropriate action such as shutting down the heater or burner by terminating fuel flow. In such a manner, serious safety problems such as continued fuel flow into a hot burner without a flame being present for combusting the fuel are avoided.

However, it is inconvenient to terminate the fuel flow if the flame is present and the burner is working properly. The termination of the fuel flow causes termination of the operation of the burner or heater unintendedly if the flame sensor sends an incorrect signal to the control panel. The present invention has as an object the avoidance of inadvertent burner shutdown and, as well, the avoidance of burner operation when the flame is extinguished.

One reason for unintended burner shutdown is signal contamination of the signal from the flame sensor, Since the power of the signal previously sent to the amplifier is quite small, in the range of 50 mv to 200 mv, and since the amplifier was located some distance from the sensor, any noise caused by common mode radiation or other RF signals could disrupt the integrity of the signal being passed to the amplifier by the sensor. This causes incorrect information to be read by the microcontroller with the result that the heater could be inadvertently shut down or, alternatively, the heater may continue to run in a flame out condition. Both scenarios are not desirable.

A further problem with the prior art is to determine where the malfunction in the burner may occur. A number of problems may occur which will shutdown the burner or otherwise cause malfunctions. Troubleshooting such malfunction can be time consuming, inefficient and costly.

SUMMARY OF THE INVENTION

According to one aspect of the invention, there is provided a flame monitor for sensing the presence of flame in a burner, said flame monitor comprising a sensor located adjacent said flame to sense the variation in radiation emanating from said flame and to produce a first signal, an amplifier to amplify said signal being received from said sensor and to pass said amplified signal to a microcontroller located remotely from said amplifier and said sensor, said microcontroller being operable to terminate operation of said burner upon receiving a predetermined change in said signal being received from said amplifier.

According to a further aspect of the invention, there is provided a method for sensing the presence of flame in a burner and for terminating operation of said burner when said flame is not present comprising the steps of sensing the presence of radiation from said flame with a sensor located relatively closely to said flame and sending a signal from said sensor to an amplifier when said radiation is sensed, said signal being amplified by said amplifier with relatively little change occurring in said signal between said sensor and said amplifier and forwarding said amplified signal to a microcontroller located remotely from said sensor and said amplifier.

According to a further aspect of the invention, there is provided apparatus for monitoring connection integrity between an amplifier and a microcontroller, said connection comprising positive, ground and signal connectors, a missing pulses detector operable to determine the presence or absence of pulses in said connection and a sensor supervisor to monitor the transition of voltage from a high to a low or a low to a high condition, either of said missing pulses detector or said sensor supervisor sending an alarm condition signal to said microcontroller if said missing pulses detector detects missing pulses or if said sensor does not sense voltage transition.

According to yet a further aspect of the invention, there is provided a method of monitoring connection integrity between an amplifier used to amplify the signal received from a sensor and a microcontroller, said method comprising generating a series of pulses in a signal connection, monitoring said pulses with a missing pulses detector and generating an alarm signal when said missing pulses detector detects missing pulses in said signal connection.

According to still yet a further aspect of the invention, there is provided a method of monitoring connection integrity between an amplifier used to amplify the signal received from a sensor and a microcontroller, said connections comprising a positive and a ground connection extending between said amplifier and said microcontroller, said method comprising monitoring the positive and ground connections with a sensor supervisor, said sensor supervisor transitioning from a high to a low or a low to a high voltage condition if one of said positive or ground connections are interrupted and said sensor supervisor generating an alarm signal to said microcontroller if said voltage transitions from said high to said low or said low to said high condition.

BRIEF DESCRIPTION OF THE SEVERAL VIEWS OF THE DRAWINGS

Specific embodiments of the invention will now be described, by way of example only, with the use of drawings in which:

FIG. 3 is a diagrammatic schematic of the main board which includes the missing pulses detector and the sensor supervisor of FIGS. 2A and 2B;

DESCRIPTION OF SPECIFIC EMBODIMENT

Figure 6:
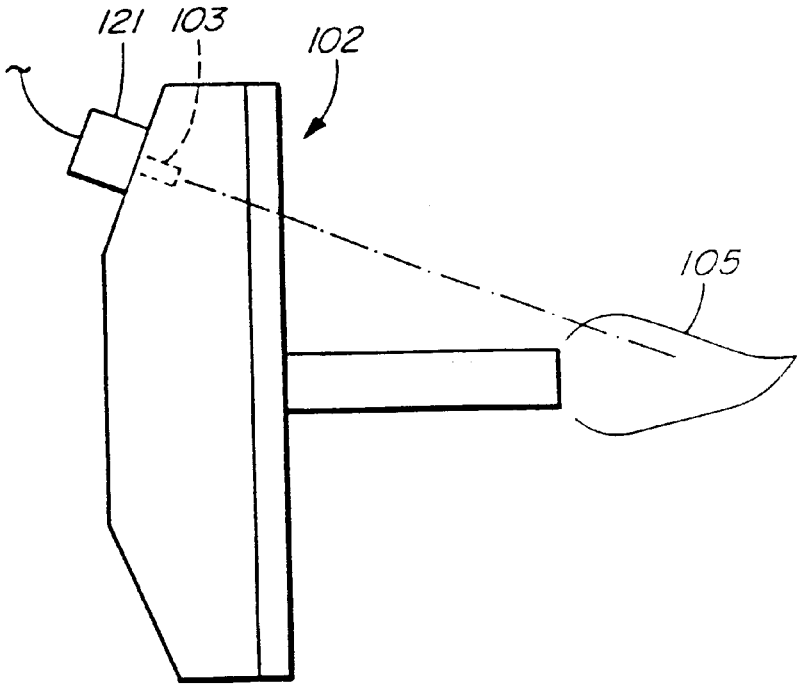
FIG. 6 is a diagrammatic isometric view illustrating the position of the flame sensor relative to the flame being sensed.
Figure 7:
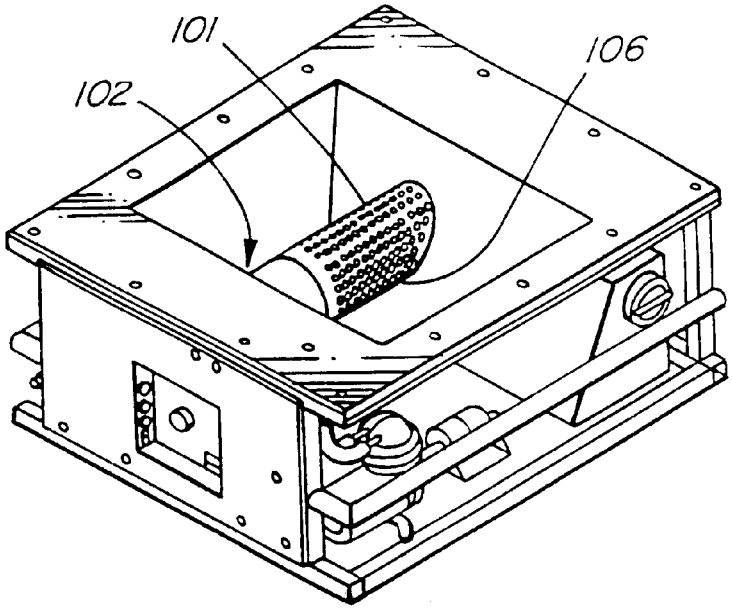
FIG. 7 is a diagrammatic isometric view of a powered multifuel burner which utilises the flame sensor according to the invention.

Referring now to the drawings, a powered multifuel burner is generally illustrated at 100 in FIG. 7. An infrared type burner 101 has a flame 105 (FIG. 6) generated within the cylinder 106 of the burner 101 by way of an air aspirated nozzle (not shown) which uses a venturi effect to draw fuel into the nozzle. Combustion takes place outside the nozzle but within the cylinder 106. The flame sensor 110 is located generally at 102 as illustrated in FIG. 6.

The flame sensor 110 may include either an infrared sensor or an ultraviolet sensor or, alternatively, a combination of an infrared and ultraviolet sensor. Each or both of the sensors 103 are positioned in the housing 121 (FIG. 4A) to sense the visible infrared and ultraviolet radiation produced by the combustion flame. The sensors 103 selected for the particular application will depend on the flame being produced within the burner 100. If, for example, the flame burns with an orange patina, the primary sensor will be infrared.

Alternatively, if the flame burns primarily with blue radiation, an ultraviolet sensor will be utilised.

Figure 1A:
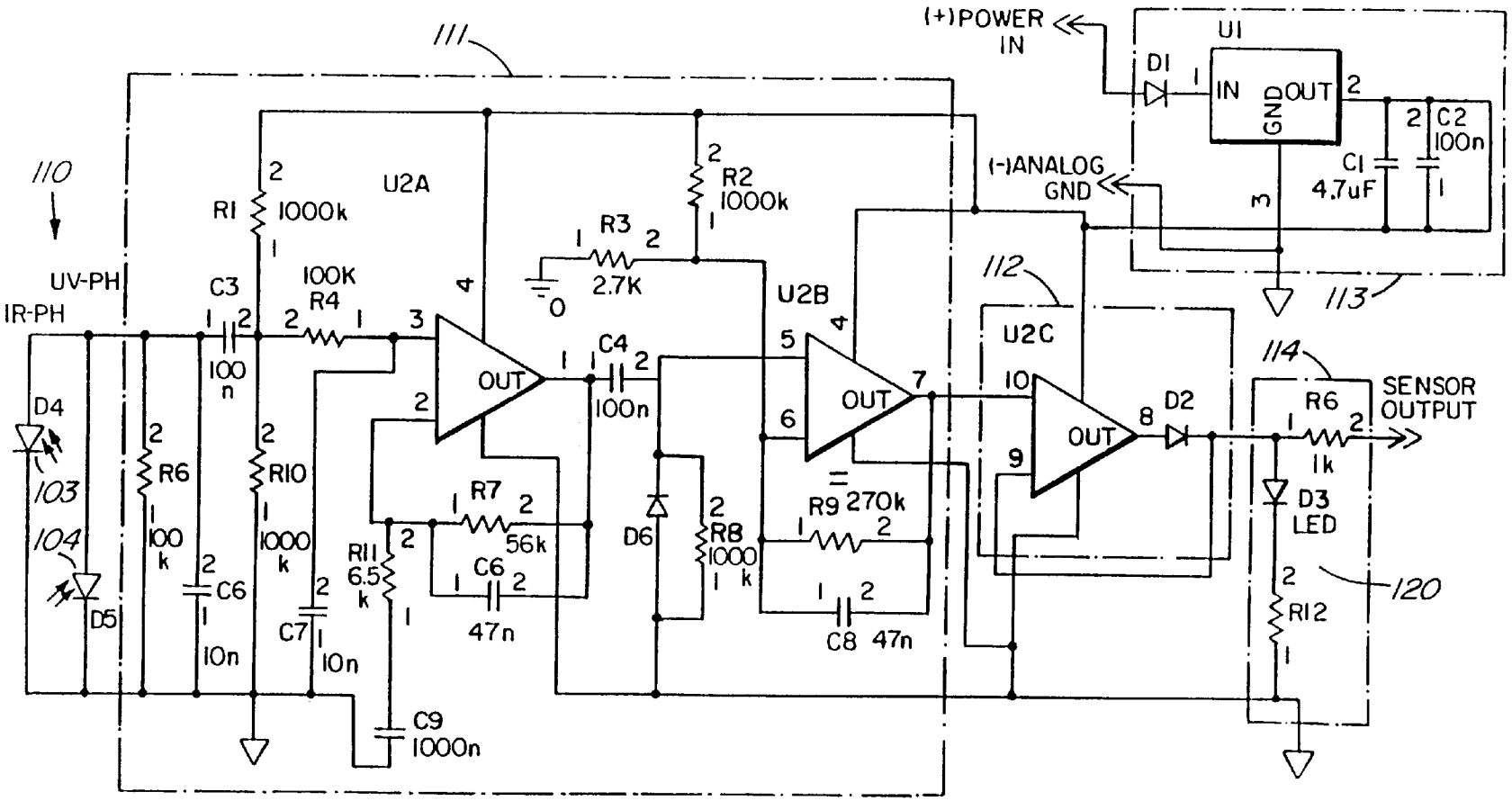
FIG. 1A is a diagrammatic schematic of the flame sensor by way of photodiode which incorporates the amplifier circuitry according to a first aspect of the invention.
Figure 1B:
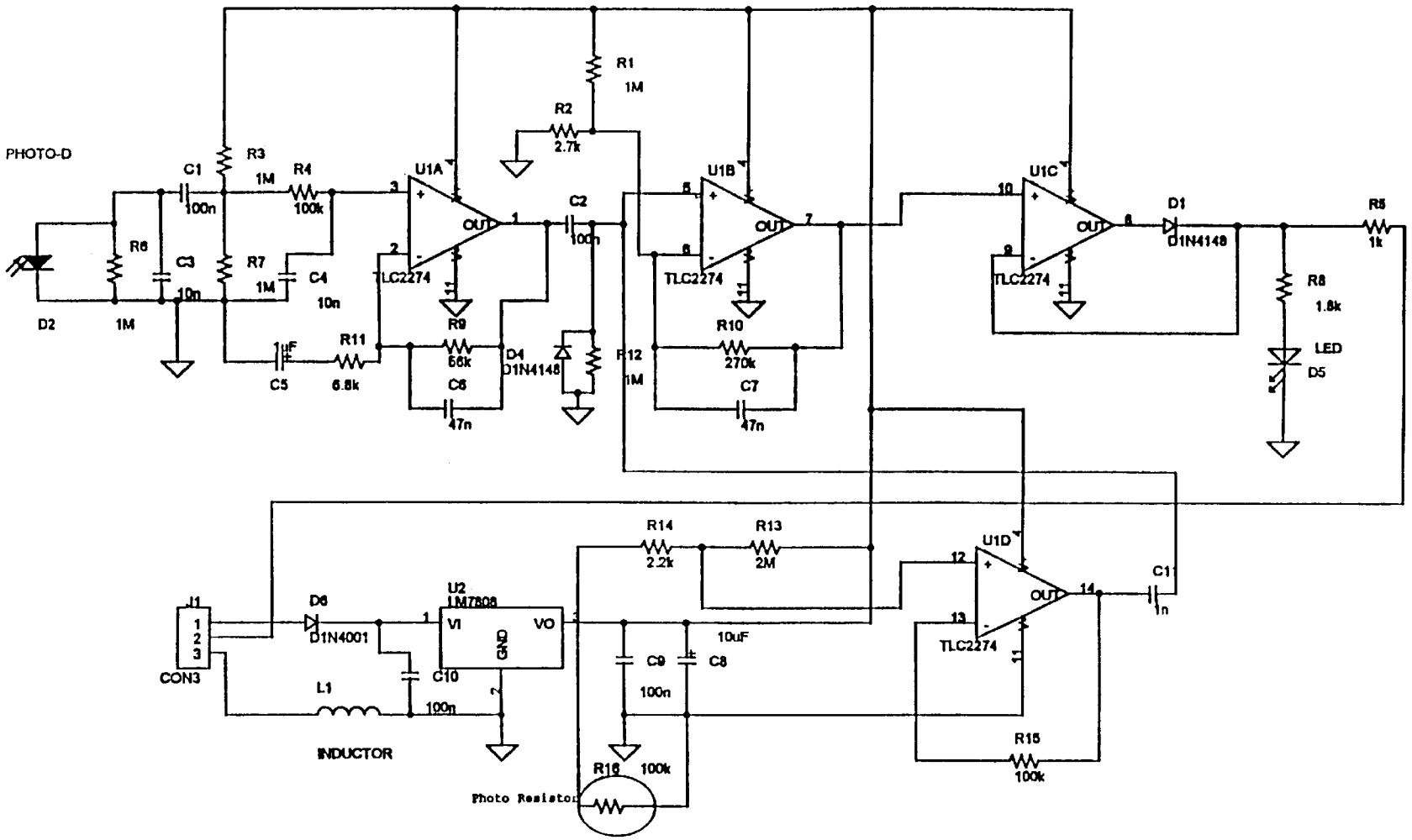
FIG. 1B is similar to FIG. 1A but illustrates the use of a flame sensor which is a photoresistor rather that the photodiode of FIG. 1A.

The schematic of FIG. 1 discloses both infrared and ultraviolet sensors 103, 104 and their related circuitry. The sensors 103, 104 are photodetectors shown generally at 110. The output from the sensors 103, 104 passes to a real to real integrator amplifier section 111. A rectifier 112 rectifies the signal passing from the amplifier section 111. A voltage regulator 113 is used to regulate the voltage and a read out circuit 114 is used to show the conditions of the signal passing from the sensors 103, 104, the amplifier 111 and rectifier 112. The read our circuit is exemplified by an LED generally shown at 120 in FIGS. 1 and 4A.

All of the components of the schematic of FIG. 1 are included with the sensors 103, 104 and are mounted within the housing 121 (FIGS. 4A, 4B and 5) associated with the sensors 103, 104. It will thereby be seen that the components described, particularly the amplifier circuit 111, are located closely to the sensors 103, 104 and, indeed, are directly connected thereto to avoid the need for cables and the like to run from the sensors 103 to the main board 124 where further processing is accomplished. This allows the relatively small signal generated by the sensors 103, 104 to be amplified without the signal picking up noise from ground terminal and RF radiation which may be present and picked up by the cables if the sensors 103, 104 were separated from the amplifier 111 which otherwise would be located in the main board 124.

Figure 2A:
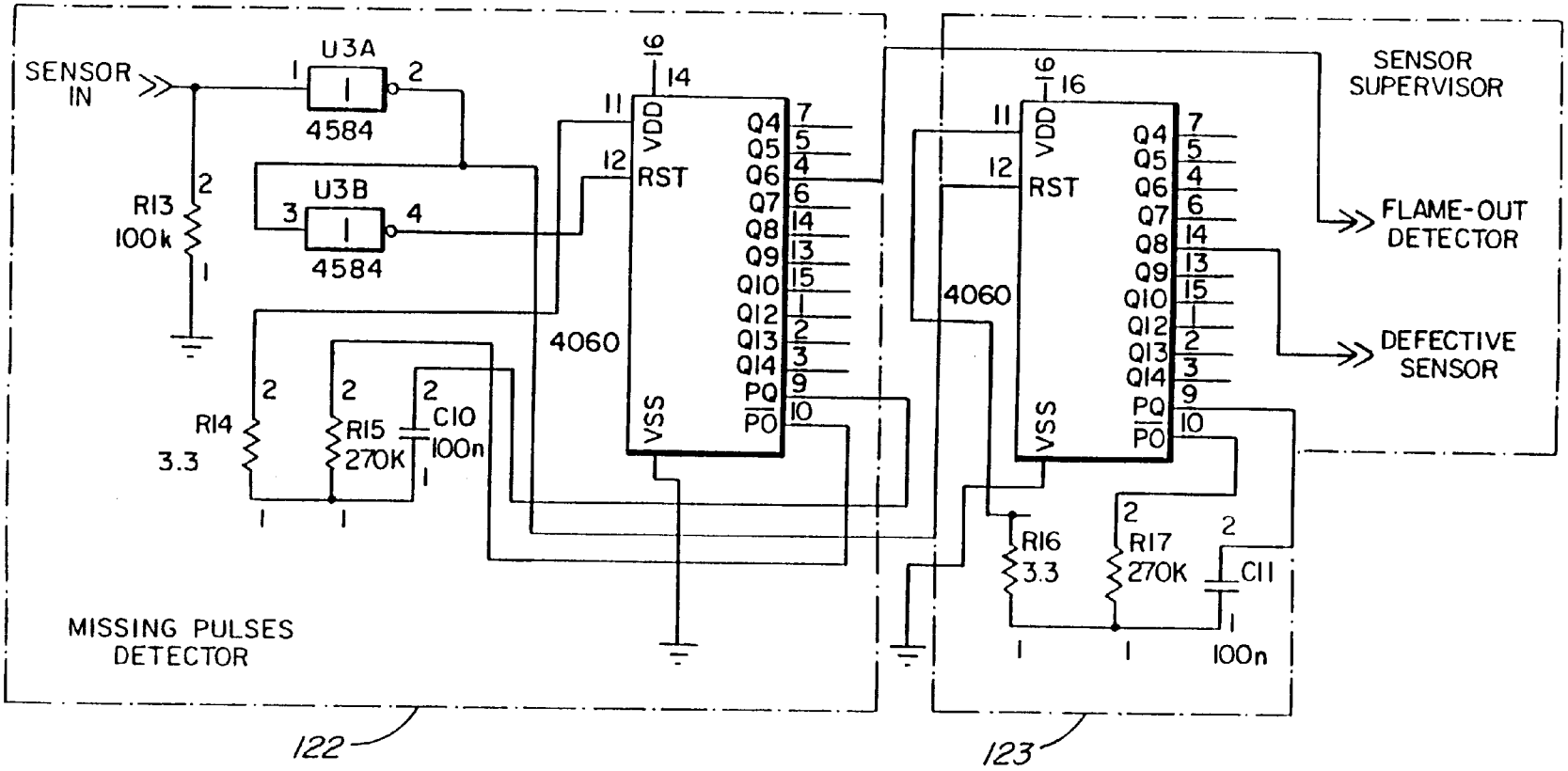
FIG. 2A is a diagrammatic schematic of the missing pulses detector and sensor supervisor used for monitoring the flame sensor signal and the integrity of the connections between the amplifier and the microcontroller.

The missing pulse detector and the sensor supervisor are generally illustrated at 122, 123, respectively, in FIG. 2. These circuit components are located remotely from the sensor housing 121 and on the main board illustrated generally at 124 in FIG. 3. These components 122, 123, as well as the remaining main board circuit components which will be described are separated from the components of FIG. 1 by cable 129 (FIG. 4A) and are remote from the housing 121 of the sensors 103, 104.

Figure 2B:
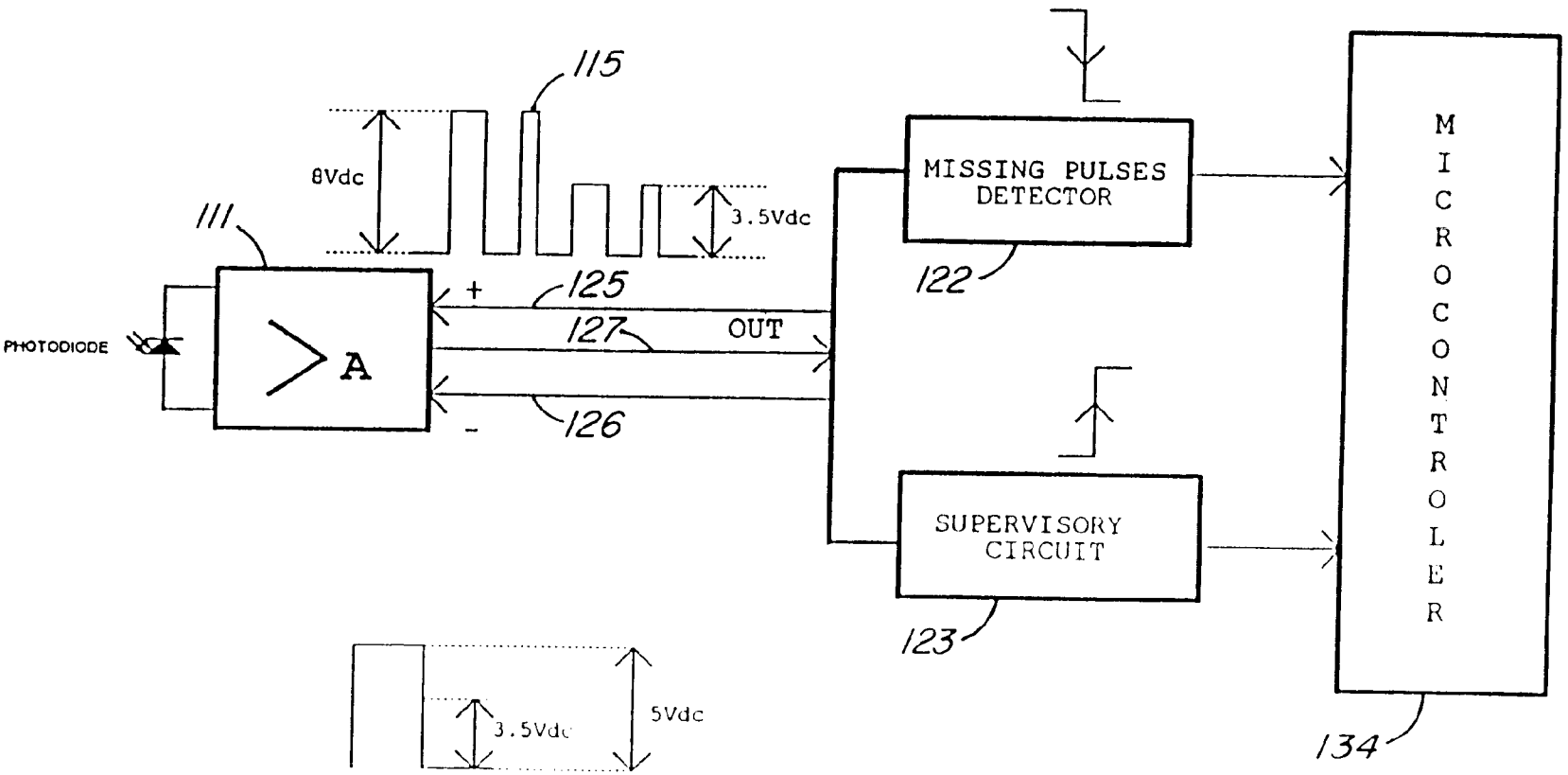
FIG. 2B is a diagrammatic and enlarged schematic particularly illustrating the connections between the amplifier and the microcontroller, the missing pulses detector and the supervisory circuit.
Figure 3A:
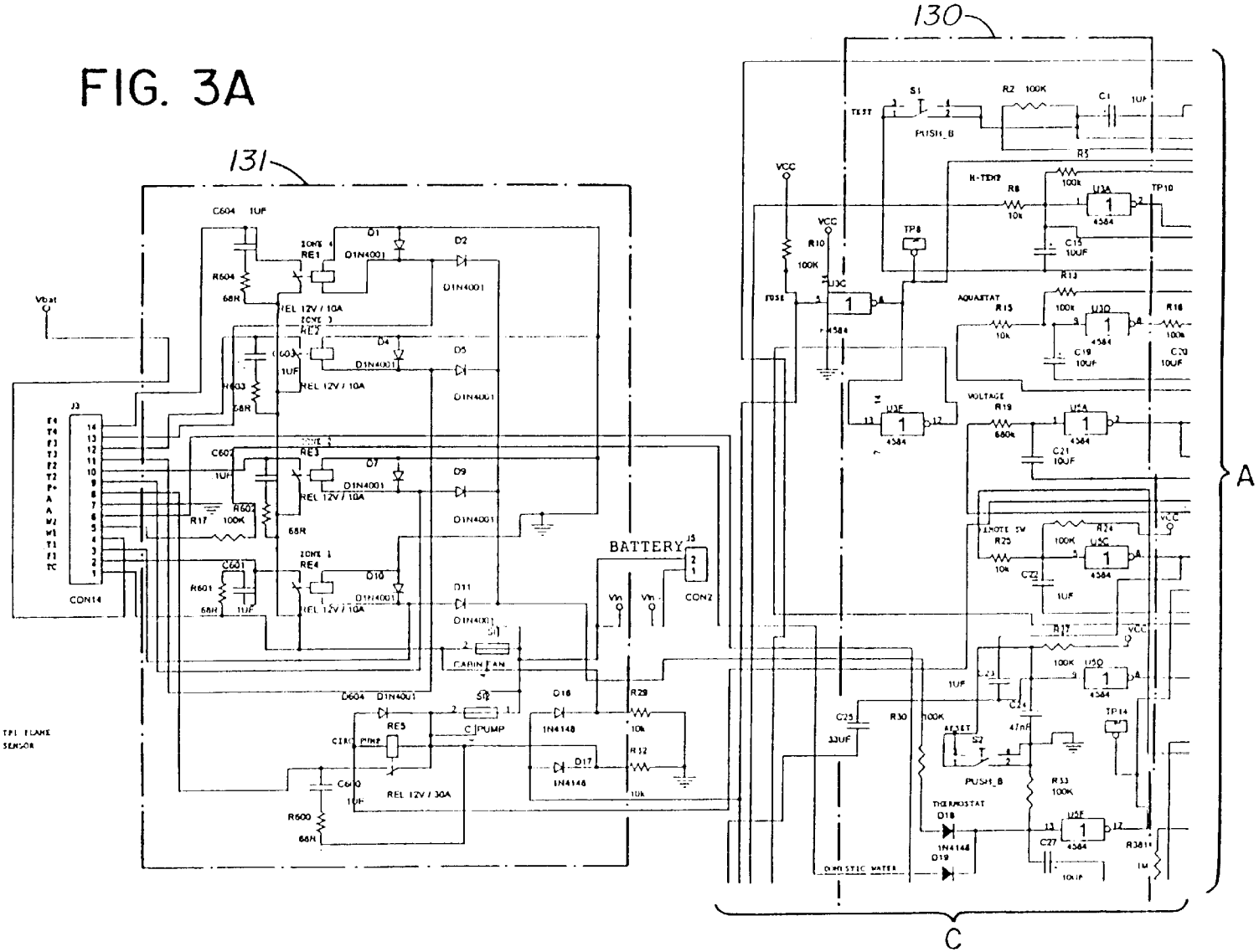
FIGS. 3A–3F are diagrammatic schematics of the main control board which includes the missing pulses detector and the sensor supervisor of FIGS. 2A and 2B.
Figure 3B:
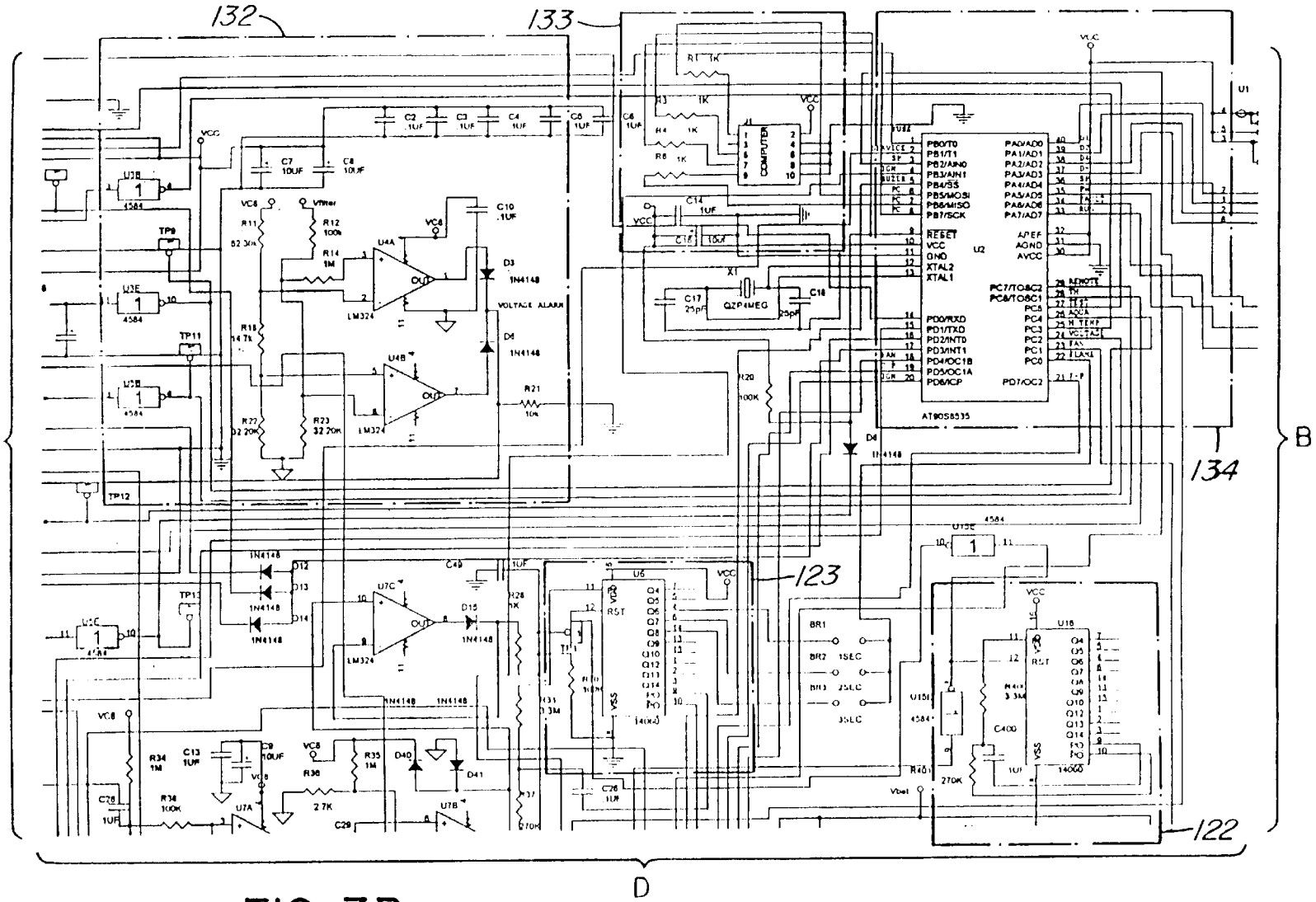
Figure 3C:
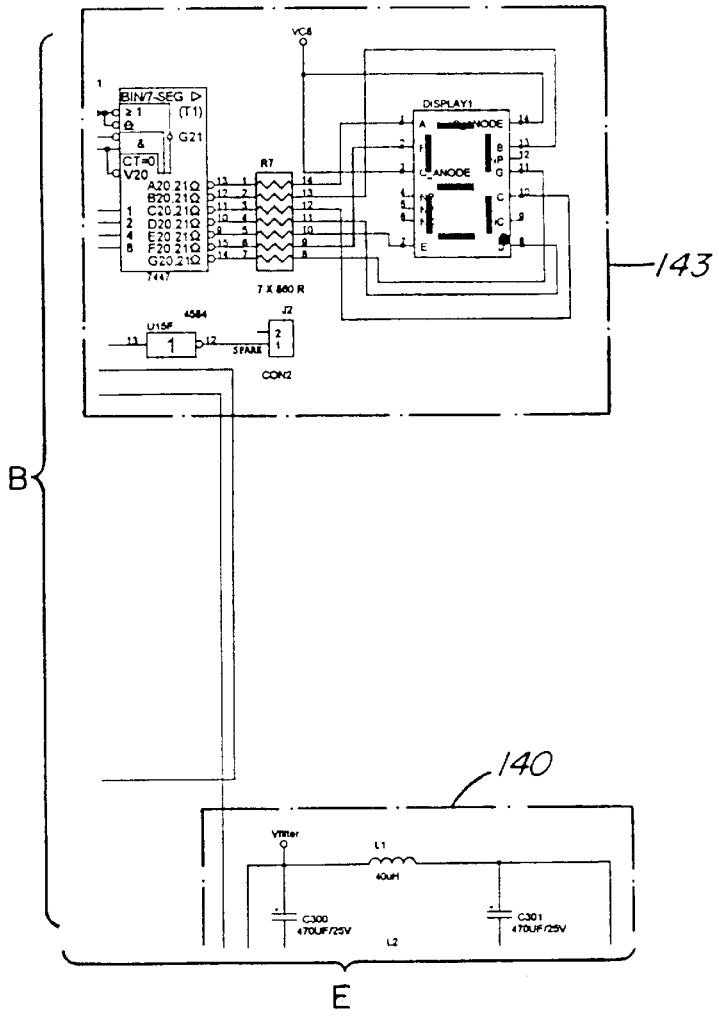
Figure 3D:
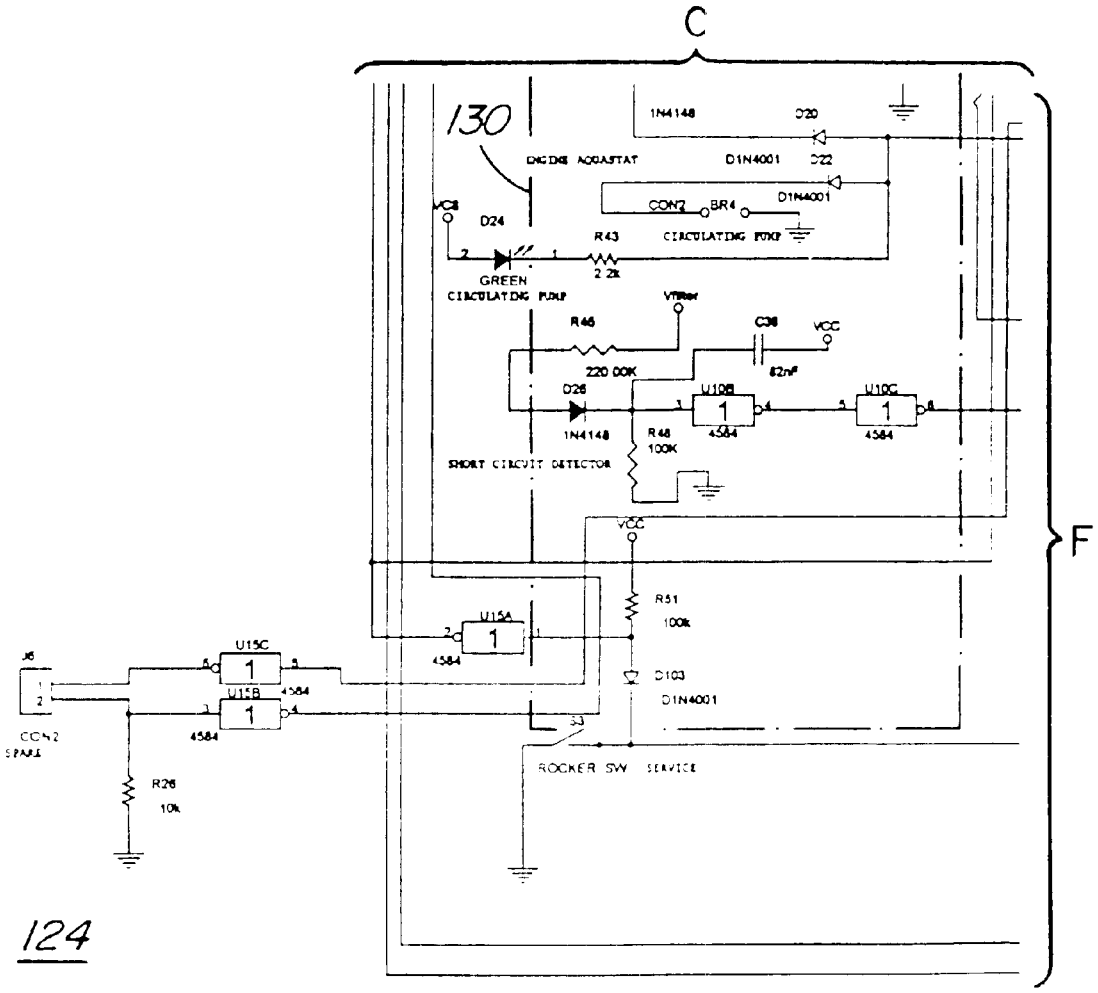
Figure 3E:
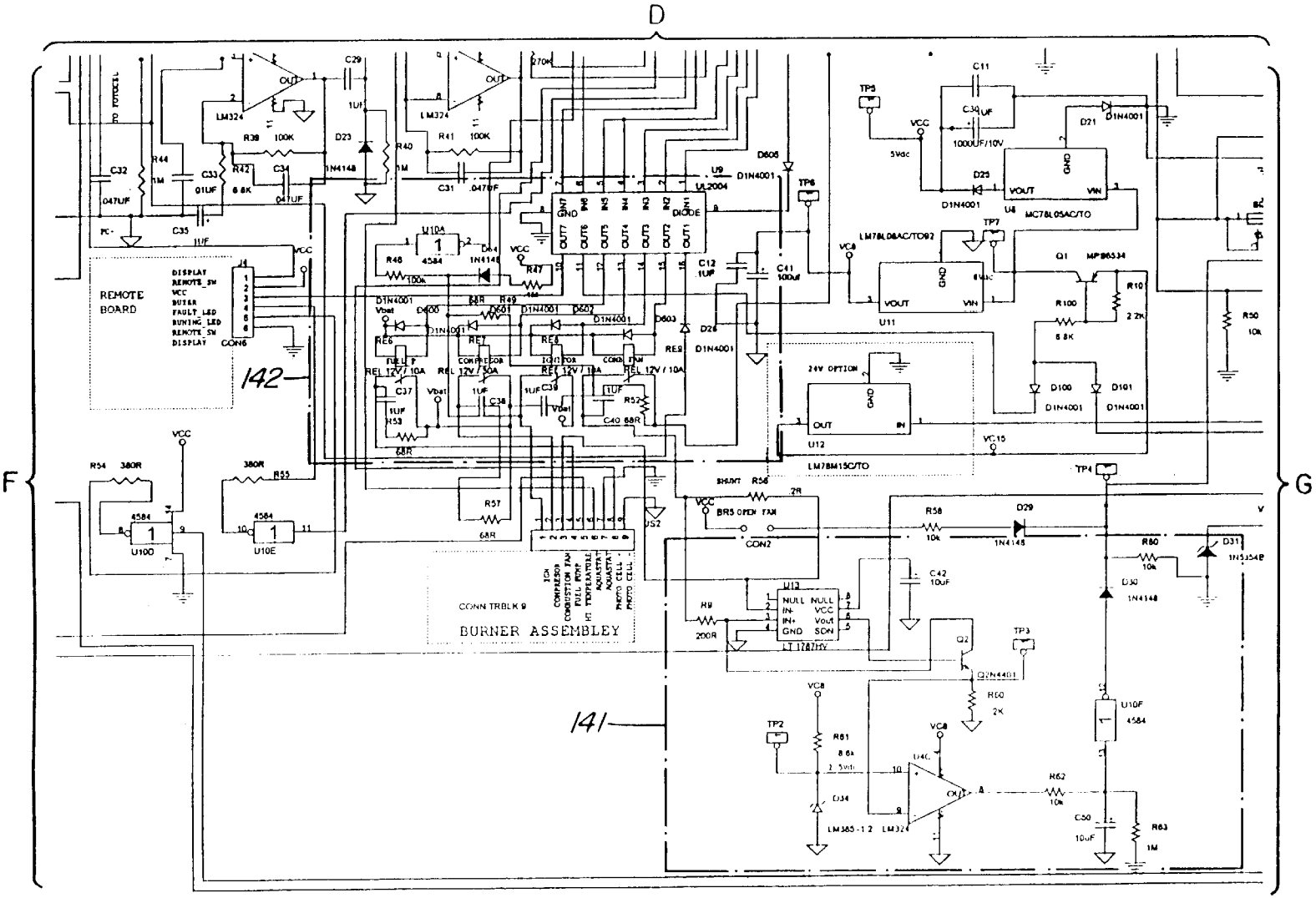
Figure 3F:
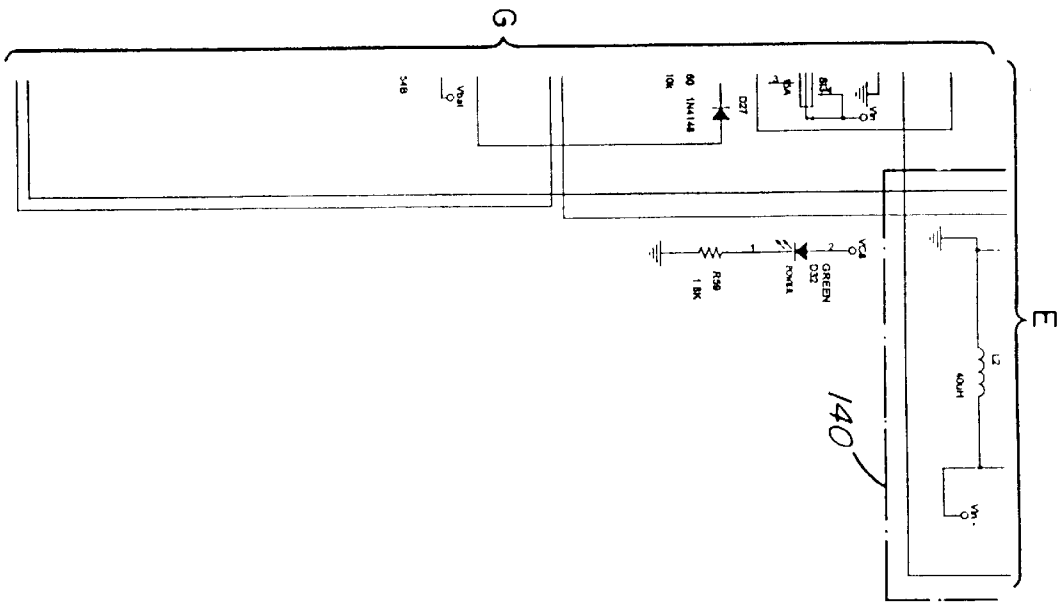

Referring to FIGS. 2B and 3, the missing pulses detector 122 and the sensor supervisor 123 are shown in greater detail and are included on the main board 124. In addition, the burner r interface circuitry 130, zone board 131, voltage supervisor 132, computer interface 133, microcontroller 134, filter 140, open circuit for combustion fan supervisory 141 and relay driver 142 are further included on the main board 124. A display unit 143 is included on the main board 124 which shows the status of the various functions of the burner 100.

OPERATION

In operation, combustion of the fuel in burner 100 (FIG. 5) will be initiated and, following the initiation of the combustion, the sensors 103, 104 will be activated to monitor the flame of the burner 100. At the beginning of the ignition, the flame sensors 103, 104 receive power. The sensors 103, 104 are located adjacent the flame of the burner 100 (FIG. 6) and sense the infrared and ultraviolet radiation, respectively, emanating from the flame 105. The circuitry associated with the flame sensors 103, 104 generates a series of pulses 115 (FIG. 2B) read by the missing pulses detector 122. In the event the flame shuts down, no pulses will be generated with the result that the missing pulses detector 122 will sense the missing pulses and instruct the microcontroller 134 accordingly in order to shut down the burner 100.

The signal from the photodetectors or sensors 103, 104 will pass to the real to real integrator amplifier 111 and, thence, to rectifier 112. Voltage regulator 113 will regulate the voltage of the signal generated by the amplifier 111 and the signal leaving rectifier 112 will pass to the missing pulses detector 122. The LED 120 will show the status of the sensors 103, 104 while under operation.

Figure 4A:
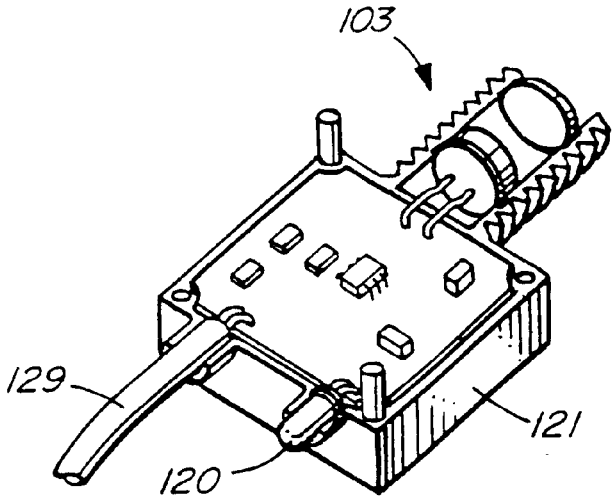
FIGS. 4A and 4B are diagrammatic isometric cutaway views of the housings used to house the flame sensor, the amplifier, the sensor supervisor and their related circuitry.
Figure 4B:
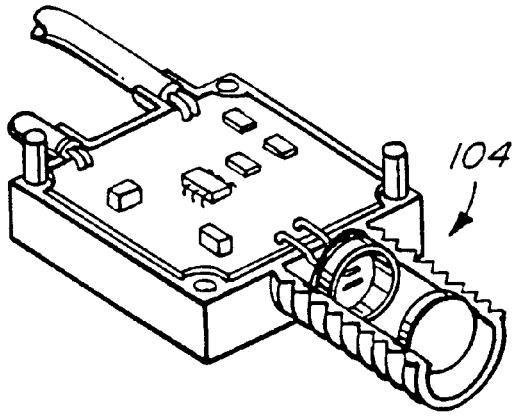
Figure 5:
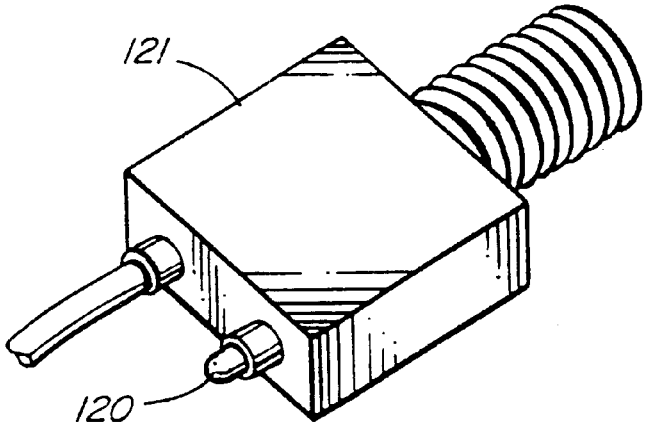
FIG. 5 is a diagrammatic isometric view of a housing but not being illustrating in cutaway.

The signal from the rectifier 112 which passes to the missing pules detector 122 will appear at "A" in FIG. 4A. The remaining circuitry illustrated in FIG. 3, including the missing pules detector 122 and the sensor supervisor 123 are located remotely from the sensors 103, 104, by way of cables 125, 126, 127 (FIG. 2B).

With reference to FIG. 3, the remaining circuitry related to the sensors 103, 104 is illustrated. Such circuitry includes circuitry relating to the operation of the burner 100 and the various functions that the burner 100 must fulfil. However, the circuitry described and its position within the housing 121 adjacent to the sensors 103, 104 allow the signal from the sensors 103, 104 to be amplified prior to conveying the signal to the main board 124 with the result than any noise or other RF frequency added to the signal is relatively much smaller than the amplified signal leaving from "B" of FIG. 1 with the result that the signal is relatively clean and may be clearly determined by the missing pulses detector 122 and supervisor circuit 123 so as to determine the condition of the flame in the burner 100 without fear of common mode RF radiation that might otherwise be gathered by the cables 125, 126, 127 creating an erroneous signal to the missing pulses detector 124 and sensor supervisor 123.

If the burner 100 terminates operation, it may be desirable to determine the reason for such shutdown. There are several problems that may cause such shutdown as described hereinafter.

First and most likely, the burner 100 becomes starved for fuel because of fuel exhaustion. In this event, the flame out condition will initiate operation of the microcontroller 134 in an attempt to again commence operation of the burner 100. This in intended, for example, to deal with the problem of an air bubble in the fuel line to the burner 100. If, following three (3) attempts to commence operation of the burner 100, the burner 100 fails in continued operation, the burner 100 will remain in its shutdown condition and operator intervention will be required.

Second, it may be that the positive wires 125 (FIG. 2B) become disconnected between the amplifier 111 and the microcontroller 134 of the main board 124. In this event, the burner 100 will be in the shutdown condition and the operator will initiate power flow to the burner 100. The LED 120 will not flash since the circuit between the amplifier 111 and the main board 124 is not complete. The operator will then know that either the positive or ground wires 125, 126 are defective.

If LED 120 flashes when power flow commences, the positive and ground wires 125, 126 are not the reason for the shutdown and the burner 100 will commence operation. If the LED 120 is not flashing when the flame is again present, the sensor 103 itself is at fault. If the LED 120 is flashing and the sensor 103 is functioning, it indicates that the signal wire 127 between the amplifier 111 and the main board is defective.

The time of burner shutdown and the number of attempted restarts of the burner may, of course, be clearly changed by appropriate programming of the microcontroller 134. The sensor 103 can operate into a range of 8–40 VDC supply voltage. The signal and the output will be in the range of 0–8 VDC if the output signal stays at high level (over 3.5 VDC) for a period of time which exceeds the present time in the sensor supervisory circuit and an alarm signal will be generated by the sensor supervisory circuit to the microcontroller 134 to shut down the burner.

While a photodiode and a photoresistor have been illustrated and described, various other sensors could likewise be used including a phototransistor and a photocell.

Many modifications will readily occur to those skilled in the art to which the invention relates and the specific embodiments described should be taken as illustrative of the invention only and not as limiting its scope as defined in accordance with the accompanying claims.

We claim:

1. A flame monitor for sensing the presence of flame in a burner, said flame monitor comprising a sensor to sense radiation variation emanating from said flame and to produce a first pulsed signal having a signal to noise ratio, said sensor being operably located adjacent to said flame, an amplifier associated with said sensor to amplify said signal being received from said sensor and to pass said amplified signal to a missing pulses detector and subsequently to a micro-controller, said micro-controller being located remotely from said amplifier and said sensor, said micro-controller being operable to terminate operation of said burner upon receiving a predetermined change in said signal being received from said missing pulses detector, said signal to noise ratio being constant between said sensor and said amplifier, said amplified signal passed to said micro-controller being an analog signal.

2. A flame monitor as in claim 1 wherein said sensor is mounted within a housing, said housing being located adjacent to said flame being monitored.

3. A flame monitor as in claim 2 wherein said amplifier is mounted within said housing.

4. A flame monitor as in claim 3 wherein said missing pulses detector is operably associated with a sensor supervisor.

5. A flame monitor as in claim 4 wherein said missing pulse detector or said sensor supervisor are operable to pass an alarm signal to said micro-controller.

6. A flame monitor as in claim 5 wherein said missing pulses detector and said sensor supervisor are separated from said amplifier by conductors.

7. A flame monitor as in claim 6 wherein said conductors are cables.

8. A flame monitor as in claim 1 wherein said amplifier amplifies said signal from said sensor between 15–80 Hz.

9. A flame monitor as in claim 1 and further comprising apparatus for monitoring the connection integrity between said amplifier and said micro-controller, said connection apparatus comprising positive, ground and signal connectors, a missing pulses detector operable to determine the presence or absence of pulses in said connectors and a sensor supervisor to monitor the transition of voltage from a high to a low or a low to a high condition in a predetermined period of time, either of said missing pulses detector or said sensor supervisor sending an alarm condition signal to said micro-controller if said missing pulses detector detects missing pulses or said sensor supervisor senses said voltage transition.

10. A method for sensing the presence of flame in a burner and for terminating operation of said burner when said flame is not present comprising the steps of sensing the presence of variation in radiation from said flame with a sensor located relatively closely to said flame and sending a pulsed signal having a signal to noise ratio from said sensor to an amplifier when said variation in radiation is sensed, said signal to noise ratio of said pulsed signal being amplified by said amplifier being constant between said sensor and said amplifier, analysing said amplified signal in analog form within a micro-controller located remotely from said amplifier and passing an alarm signal to said micro-controller when said analysed analog signal falls outside a predetermined range.

11. Method as in claim 9 wherein said amplifier amplifies said signal from said sensor falling between approximately 15–80 Hz.

12. A method as in claim 10 and further comprising monitoring the connection integrity between said amplifier used to amplify the signal received from a sensor and said micro-controller, comprising generating a series of pulses in a signal connection, monitoring said pulses with a missing pulses detector and generating an alarm signal when said missing pulses detector detects missing pulses in said signal connection in a predetermined period of time.

13. A method as in claim 10 and further comprising monitoring the connection integrity between said amplifier used to amplify the signal received from a sensor and a micro-controller, said connection comprising a positive and a ground connection extending between said amplifier and said micro-controller, said method further comprising monitoring the positive and ground connections with said sensor supervisor, said sensor supervisor transitioning from a high to a low or a low to a high voltage condition if one of said positive or ground connections are interrupted and said sensor supervisor generating an alarm signal to said micro-controller if said voltage transitions from said high to said low or said low to said high condition.

* * * * *